US011192123B2

(12) United States Patent
Chen

(10) Patent No.: US 11,192,123 B2
(45) Date of Patent: Dec. 7, 2021

(54) INTEGRATED DEVICE FOR WATER STREAMING AND SPRAYING

(71) Applicant: Bo Chen, Guangdong (CN)

(72) Inventor: Bo Chen, Guangdong (CN)

(73) Assignee: Shantou P&C Plastic Products Company Limited, Shantou (CN)

( * ) Notice: Subject to any disclaimer, the term of this patent is extended or adjusted under 35 U.S.C. 154(b) by 202 days.

(21) Appl. No.: 16/716,539

(22) Filed: Dec. 17, 2019

(65) Prior Publication Data

US 2021/0060583 A1 Mar. 4, 2021

(30) Foreign Application Priority Data

Aug. 30, 2019 (CN) ..... 201921431467.6

(51) Int. Cl.
*B05B 1/12* (2006.01)

(52) U.S. Cl.
CPC ..... *B05B 1/12* (2013.01)

(58) Field of Classification Search
CPC ..... B05B 7/10; B05B 1/34; B05B 1/1681; B05B 15/65
USPC ..... 239/578, 589
See application file for complete search history.

(56) References Cited

U.S. PATENT DOCUMENTS 4,618,100 A * 10/1986 White ..... B05B 1/12 239/440
5,836,514 A * 11/1998 Handfield ..... F25C 3/04 239/14.2
8,684,235 B2 * 4/2014 Inaba ..... B05B 11/3011 222/153.13
10,890,411 B1 * 1/2021 Chen ..... F41B 9/0075
2006/0086762 A1 * 4/2006 Foster ..... B05B 11/3087 222/383.1
2009/0256008 A1 * 10/2009 Foster ..... B05B 7/005 239/539
2016/0136659 A1 * 5/2016 Erickson ..... F16K 11/20 239/443
2017/0173602 A1 * 6/2017 Erickson ..... B05B 1/3026
2018/0264487 A1 * 9/2018 Fujiwara ..... B05B 1/12
2019/0001351 A1 * 1/2019 Mickos ..... B05B 1/12
2019/0186689 A1 * 6/2019 Smedresman ..... F16N 21/04
2020/0282410 A1 * 9/2020 Denmat ..... B05B 1/28
2021/0060583 A1 * 3/2021 Chen ..... F41B 9/0075
2021/0063110 A1 * 3/2021 Chen ..... F41B 9/0075

* cited by examiner

*Primary Examiner* — Joseph A Greenlund
(74) *Attorney, Agent, or Firm* — Minder Law Group; Willy H. Wong

(57) ABSTRACT

An integrated device for water streaming and spraying comprises a support base, a water inlet pipe mounted on the support base, a nozzle including an outer tube mounted on the water inlet pipe and an inner tube, an adjustment sleeve making sealing contact with the outer tube, and a position adjustment mechanism capable of adjusting a position of the adjustment sleeve along front and rear directions. The inner tube provided with a plurality of guide vanes is disposed in and protruding from the outer tube. A cavity of the inner tube is provided with a partition plate, the partition plate and an inner wall of the inner tube together encircle to form an opened diversion groove having a groove wall provided with at least one notch. The adjustment sleeve is disposed with a sealing plate having a water jet hole located right in front of the opened diversion groove.

8 Claims, 3 Drawing Sheets

INTEGRATED DEVICE FOR WATER STREAMING AND SPRAYING

RELATED APPLICATIONS

This application claims benefit of Chinese Patent Application No. CN 201921431467.6, filed Aug. 30, 2019.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention relates to a water gun, and more particularly to an integrated device for water streaming and spraying.

Related Art

As we all know, toy water guns are toys that children often play in the summer. There are many kinds of children's toy water guns on the market, and the structures are different. However, most of the existing toy water guns have a single function and can only stream or spray water (correspondingly, the ejected water flow is columnar or in spray pattern), which easily causes players to feel dull and boring, thereby reducing the fun and appeal of toy water gun. When it is needed to change the ejected water flow pattern of the toy water gun, it is generally required to replace the nozzle mounted on the water outlet of the toy water gun with another type of nozzle, which is inconvenient to use.

SUMMARY OF THE INVENTION

One technical problem to be solved by the present invention is to provide an integrated device for water streaming and spraying, the integrated device for water streaming and spraying can be switched between two usage modes of streaming and spraying water, and is simple and convenient to operate. One technical solution adopted is as follows:

One embodiment of an integrated device for water streaming and spraying comprising:

a support base;

a water inlet pipe, the water inlet pipe being mounted on the support base and disposed along front and rear directions;

a nozzle, the nozzle comprising an outer tube and an inner tube, the outer tube being mounted on a front end of the water inlet pipe;

an adjustment sleeve, the adjustment sleeve being sleeved on an outer side of the outer tube;

a position adjustment mechanism capable of adjusting a position of the adjustment sleeve along the front and rear directions;

a rear end of the outer tube communicating with the front end of the water inlet pipe, the inner tube being disposed in a cavity of the outer tube;

a front end of the inner tube protruding from a front end opening of the outer tube;

a cavity of the inner tube being provided with a partition plate, the partition plate and an inner wall of the front end of the inner tube together encircling to form an opened diversion groove;

a groove wall of the opened diversion groove being provided with at least one notch;

an outer side surface of the inner tube being provided with a plurality of guide vanes arranged in a circumferential direction of the inner tube;

an outer edge of each of the guide vanes contacting and fitting with an inner side surface of the outer tube;

an inner side surface of the adjustment sleeve making sealing contact with an outer side surface of the outer tube;

a front end of the adjustment sleeve being disposed with a sealing plate; and a water jet hole being disposed on the sealing plate, the water jet hole being located right in front of the opened diversion groove.

In one embodiment of the above-mentioned nozzle, a space between the outer tube and the inner tube is partitioned by each of the guide vanes into a plurality of diversion cavities arranged along the circumferential direction of the inner tube, and each of the diversion cavities respectively communicates with a cavity of the opened diversion groove through the corresponding notch.

When in use, one embodiment of the support base of the above-mentioned integrated device for water streaming and spraying can be installed on a toy water gun, a rear end of the water inlet pipe communicates with a water outlet of the toy water gun, and the toy water gun is capable of transporting water through the water outlet to the water inlet pipe of the integrated device for water streaming and spraying. The position adjustment mechanism is capable of adjusting a position of the adjustment sleeve along the front and rear directions, and switching between two positions, which are described as follows. When at a front position, an edge of a groove opening of the opened diversion groove contacts and fits with a rear side of the sealing plate. When the toy water gun is transporting water to the integrated device for water streaming and spraying, the water transported from the toy water gun flows into each of the diversion cavities through the water inlet pipe and a rear end opening of the outer tube, and then enters the opened diversion groove from the corresponding notches and flows out from the groove opening of the opened diversion groove to form a plurality of water currents with different flow directions which are directly ejected through the water jet hole on the sealing plate. Thereby effectively increasing a chance of collision between the water currents and an inner wall of the water jet hole, causing the water currents ejected from the water jet hole to be uniformly sprayed around to present the spray pattern, and leaving the toy water gun in a usage mode of spraying water. When at a rear position, the edge of the groove opening of the opened diversion groove is separated with the rear side of the sealing plate. When the toy water gun is transporting water to the integrated device for water streaming and spraying, the water transported from the toy water gun flows into each of the diversion cavities of the nozzle through the water inlet pipe, and then flows out from a front end of the outer tube or the groove opening of the opened diversion groove to form a plurality of water currents with different flow directions. The water currents are merged and diverted into a cavity of the adjustment sleeve and finally ejected from the water jet hole on the sealing plate, so that the ejected water current is columnar, and the toy water gun is in a usage mode of streaming water.

In one embodiment, a sealing ring is fixedly mounted on the outer side surface of the outer tube, and the outer side surface of the outer tube makes sealing contact with the inner side surface of the adjustment sleeve through the sealing ring.

In one embodiment, the position adjustment mechanism comprises an adjustment member, the adjustment member is mounted on the water inlet pipe, and the adjustment member is provided with a cylindrical retaining wall. The adjustment sleeve is sleeved on an inner side of the cylindrical retaining wall, the cylindrical retaining wall is provided with at least one guide groove, and the guide groove has a positioning section and a guide transition section. The positioning section extends along a circumferential direction of the cylindrical retaining wall, the guide transition section gradually extends from front to rear toward the circumferential direction of the cylindrical retaining wall, and a rear end of the guide transition section is connected with one end of the positioning section. The adjustment sleeve is provided with at least one guide slider, a quantity of the guide slider is the same as that of the guide groove, each of the guide sliders corresponds to one of the guide grooves, and each of the guide sliders is located in the corresponding guide groove. When the toy water gun needs to be in spraying mode, the guide slider is capable of moving along the guide groove on the adjustment member by rotating the adjustment sleeve, moving from the guide transition section to the positioning section of the guide groove. At this time, the adjustment sleeve reaches the rear position, so that the edge of the groove opening of the opened diversion groove contacts and fits with the rear side of the sealing plate. When the toy water gun needs to be in streaming mode, the guide slider is capable of moving from the positioning section to a front end of the guide transition section of the corresponding guide groove by rotating the adjustment sleeve in an opposite direction. At this time, the adjustment sleeve reaches the front position, so that the edge of the groove opening of the opened diversion groove is separated from the rear side of the sealing plate.

In one embodiment, the adjustment member comprises a first adjustment block and a second adjustment block, the first adjustment block and the second adjustment block are respectively sleeved on the water inlet pipe. At least one first arcuate wall is disposed on the first adjustment block, at least one second arcuate wall is disposed on the second adjustment block, and each of the first arcuate walls and each of the second arcuate walls together encircle to form the cylindrical retaining wall of the adjustment member. The first arcuate wall is provided with a front guiding surface, the second arcuate wall is provided with a rear guiding surface, a quantity of the rear guiding surface is the same as that of the front guiding surface, and each of the rear guiding surfaces corresponds to one of the front guiding surfaces. The rear guiding surface is located behind the front guiding surface and both are directly opposite each other, the rear guiding surface and the front guiding surface together encircle to form the guide groove on the cylindrical retaining wall. The position adjustment mechanism further comprises a limiting block, at least two positioning posts, and at least two compression springs. Each of the positioning posts is disposed on the support base and parallel to the water inlet pipe, the limiting block is mounted on a front end of each of the positioning posts, the limiting block is disposed with a round mounting hole, and the adjustment sleeve is sleeved in the round mounting hole. The first adjustment block and the second adjustment block are located between the support base and the limiting block, the first adjustment block is provided with a first keyway matching with each of the positioning posts, and the second adjustment block is provided with a second keyway matching with each of the positioning posts. Each of the compression springs is disposed between the support base and the second adjustment block, a rear end of each of the compression springs is connected with the support base, and a front end of each of the compression springs is connected with or in close contact with the second adjustment block. With this structure, the first adjustment block and the second adjustment block are capable of moving back and forth between the support base and the limiting block along the water inlet pipe. Through the cooperation between the first keyway and the positioning posts, and the cooperation between the second keyway and the positioning posts, the first arcuate wall and the second arcuate wall are limited in a radial direction, and movement of the first adjustment block and the second adjustment block along the water inlet pipe is more stable. Each of the compression springs is capable of exerting a certain acting force on the second adjustment block, so that the rear guiding surface on the second arcuate wall has a tendency to move toward the front guiding surface on the first arcuate wall. The adjustment sleeve is capable of rotating in the round mounting hole on the limiting block to drive the limiting block to move between the guide transition section and the positioning section of the guide groove. When the guide slider on the adjustment sleeve is at the front end of the guide transition section, the second adjustment block moves toward the first adjustment block under action of each of the compression springs, so that a spacing between the rear guiding surface and the front guiding surface is reduced to ensure that the guide slider on the adjustment sleeve is incapable of moving along the guide transition section to achieve positioning of the adjustment sleeve. When the guide slider on the adjustment sleeve is at the positioning section of the guide groove, the second adjustment block has a tendency to move toward the first adjustment block under action of each of the compression springs. The rear guiding surface presses the guide slider on the adjustment sleeve against the front guiding surface tightly to realize positioning of the adjustment sleeve.

In one embodiment, the position adjustment mechanism further comprises a rotary housing, the rotary housing is rotatably mounted on the support base, the adjustment sleeve is fixedly mounted on a front end portion of the rotary housing, and the water inlet pipe, the nozzle, the limiting block, the adjustment member, each of the positioning posts, and each of the compression springs are all located in the rotary housing. In this way, the adjustment sleeve is driven to rotate about its rotation axis by rotating the rotary housing to achieve adjusting a position of the adjustment sleeve along the front and rear directions, which makes the operation more convenient. The rotary housing is also capable of protecting the water inlet pipe, the nozzle, the limiting block, the adjustment member, the positioning posts and the compression springs, and making the toy water gun more aesthetic.

Front and rear mentioned in this specification respectively refer to: a direction of water ejection from the water outlet of the toy water gun to the integrated device for water streaming and spraying, with the rear referring to the portion where the water first arrives, and with the front referring to the portion where the water finally arrives.

One embodiment of the integrated device for water streaming and spraying of the present invention can be installed at the water outlet of the toy water gun, and the rear end of the water inlet pipe is communicated with the water outlet of the toy water gun, so that a user can adjust a position of the adjustment sleeve along the front and rear directions by the position adjustment mechanism, and adjust a spacing between the edge of the groove opening of the opened diversion groove and the rear side of the sealing plate to achieve switching between two usage modes of streaming and spraying water. The operation is simple, convenient, and versatile, providing a novel toy water gun gameplay, and, thereby enhancing the fun and appeal of the toy water gun.

DETAILED DESCRIPTION OF THE INVENTION

Figure 1:
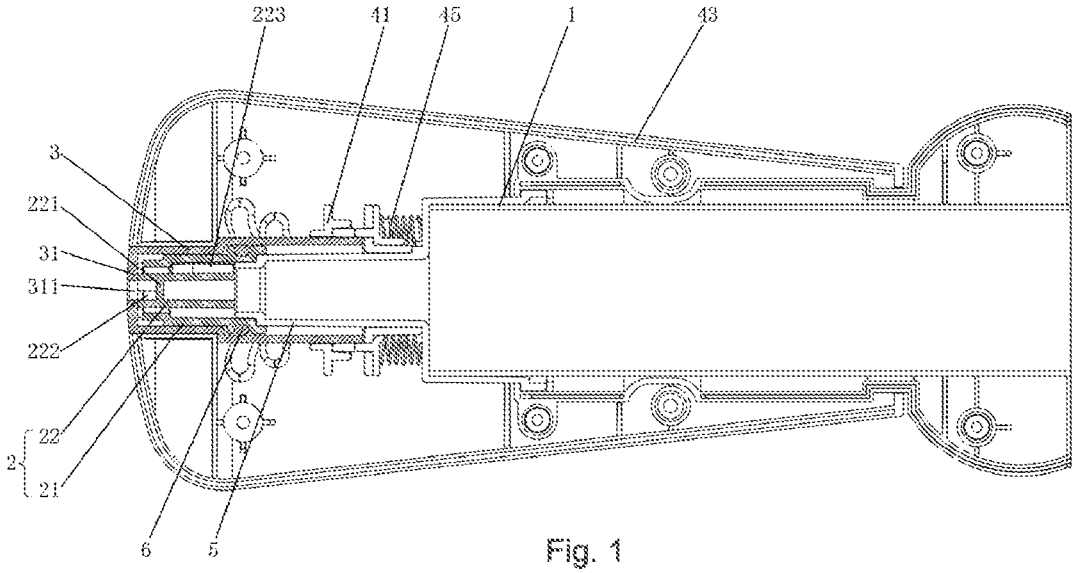
FIG. 1 is a schematic view of one embodiment of an integrated device of the present invention being used in spraying state.
Figure 2:
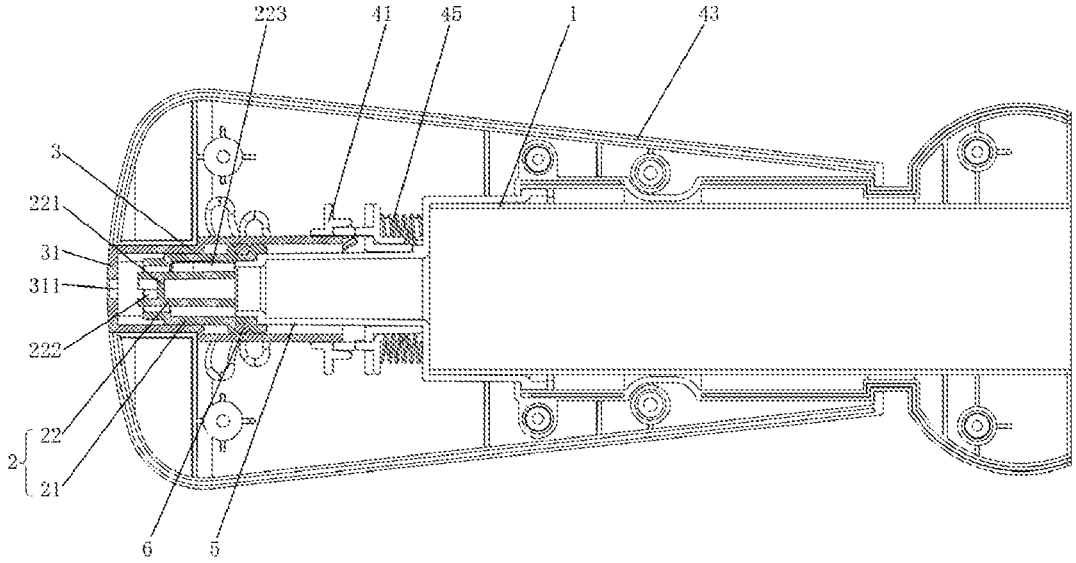
FIG. 2 is a schematic view of one embodiment of the integrated device of the present invention being used in streaming state.
Figure 3:
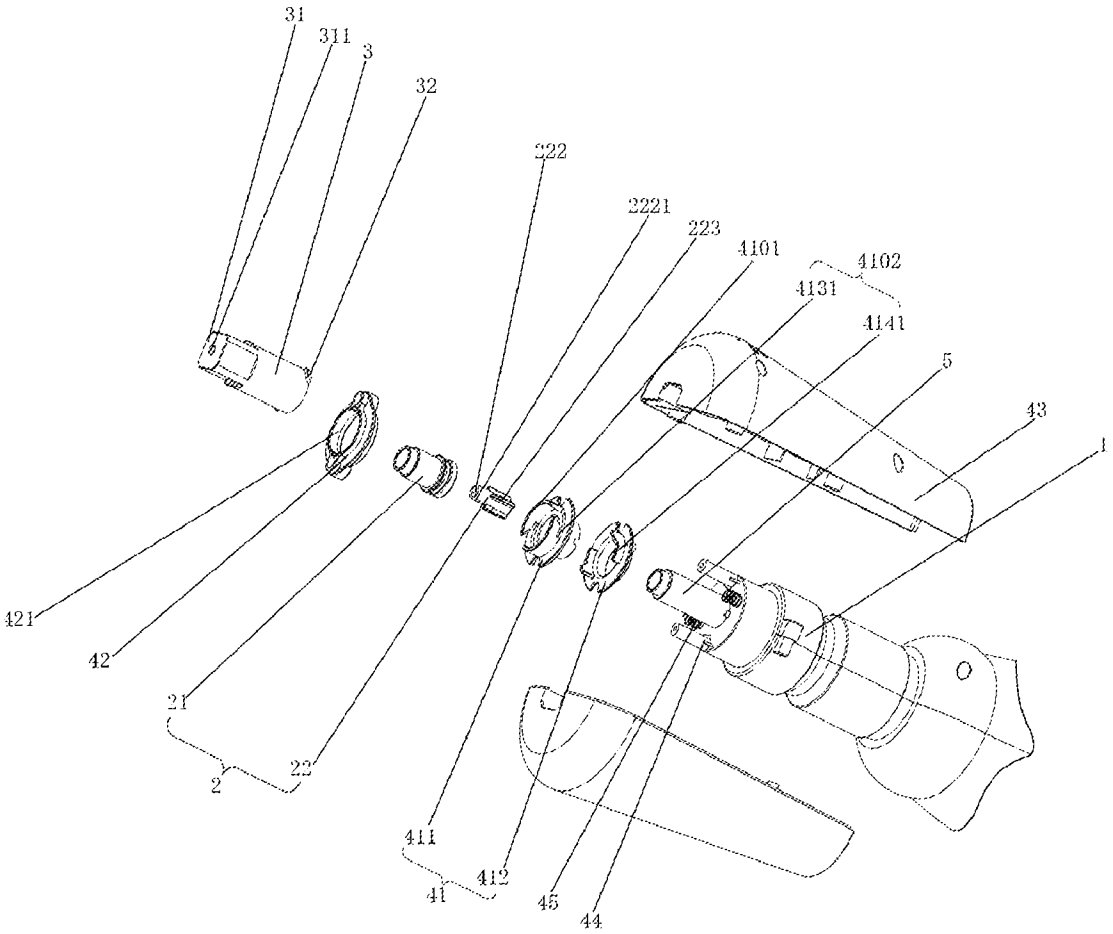
FIG. 3 is a perspective exploded view of one embodiment of the integrated device shown in FIG. 1.
Figure 4:
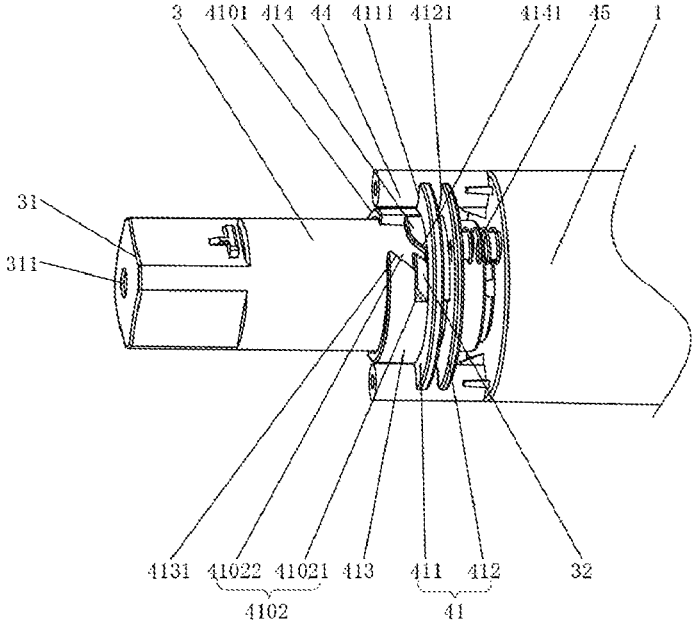
FIG. 4 is a schematic view of connection and fitting of an adjustment member, a support base, and an adjustment sleeve of one embodiment of the integrated device shown in FIG. 1.

As shown in FIG. 1 to FIG. 4, one embodiment of an integrated device for water streaming and spraying includes a support base 1, a nozzle 2, a water inlet pipe 5, an adjustment sleeve 3, and a position adjustment mechanism 4 capable of adjusting a position of the adjustment sleeve 3 along front and rear directions. The water inlet pipe 5 is mounted on the support base 1 and disposed along the front and rear directions. The nozzle 2 includes an outer tube 21 and an inner tube 22, the outer tube 21 is mounted on a front end of the water inlet pipe 5, and a rear end of the outer tube 21 communicates with the front end of the water inlet pipe 5. The inner tube 22 is disposed in a cavity of the outer tube 21, and a front end of the inner tube 22 protrudes from a front end opening of the outer tube 21. A cavity of the inner tube 22 is provided with a partition plate 221, the partition plate 221 and an inner wall of the front end of the inner tube 22 together encircle to form an opened diversion groove 222, and a groove wall of the opened diversion groove 222 is provided with a plurality of notches 2221. An outer side surface of the inner tube 22 is provided with a plurality of guide vanes 223 arranged in a circumferential direction of the inner tube 22, an outer edge of each of the guide vanes 223 contacts and fits with an inner side surface of the outer tube 21. A space between the outer tube 21 and the inner tube 22 is partitioned by each of the guide vanes 223 into a plurality of diversion cavities arranged along the circumferential direction of the inner tube 22, and each of the diversion cavities respectively communicates with a cavity of the opened diversion groove 222 through the corresponding notch 2221. The adjustment sleeve 3 is sleeved on an outer side of the outer tube 21, an inner side surface of the adjustment sleeve 3 makes sealing contact with an outer side surface of the outer tube 21, and a front end of the adjustment sleeve 3 is disposed with a sealing plate 31. A water jet hole 311 is disposed on the sealing plate 31, the water jet hole 311 is located right in front of the opened diversion groove 222.

In this embodiment, a sealing ring 6 is fixedly mounted on the outer side surface of the outer tube 21, and the outer side surface of the outer tube 21 makes sealing contact with the inner side surface of the adjustment sleeve 3 through the sealing ring 6.

In this embodiment, the position adjustment mechanism 4 comprises an adjustment member 41, the adjustment member 41 is mounted on the water inlet pipe 5, and the adjustment member 41 is provided with a cylindrical retaining wall 4101. The adjustment sleeve 3 is sleeved on an inner side of the cylindrical retaining wall 4101, the cylindrical retaining wall 4101 is provided with a plurality of guide grooves 4102, and the guide groove 4102 has a positioning section 41021 and a guide transition section 41022. The positioning section 41021 extends along a circumferential direction of the cylindrical retaining wall 4101, the guide transition section 41022 gradually extends from front to rear toward the circumferential direction of the cylindrical retaining wall 4101, and a rear end of the guide transition section 41022 is connected with one end of the positioning section 41021. The adjustment sleeve 3 is provided with a plurality of guide sliders 32, a quantity of the guide sliders 32 is the same as that of the guide grooves 4102, each of the guide sliders 32 corresponds to one of the guide grooves 4102, and each of the guide sliders 32 is located in the corresponding guide groove 4102.

In this embodiment, the adjustment member 41 comprises a first adjustment block 411 and a second adjustment block 412, the first adjustment block 411 and the second adjustment block 412 are respectively sleeved on the water inlet pipe 5. A plurality of first arcuate walls 413 are disposed on the first adjustment block 411, a plurality of second arcuate walls 414 are disposed on the second adjustment block 412, and each of the first arcuate walls 413 and each of the second arcuate walls 414 together encircle to form the cylindrical retaining wall 4101 of the adjustment member 41. The first arcuate wall 413 is provided with a front guiding surface 4131, the second arcuate wall 414 is provided with a rear guiding surface 4141, a quantity of the rear guiding surfaces 4141 is the same as that of the front guiding surfaces 4131, and each of the rear guiding surfaces 4141 corresponds to one of the front guiding surfaces 4131. The rear guiding surface 4141 is located behind the front guiding surface 4131 and both are directly opposite each other, and the rear guiding surface 4141 and the front guiding surface 4131 together encircle to form the guide groove 4102. The position adjustment mechanism 4 further comprises a limiting block 42, a rotary housing 43, two positioning posts 44, and two compression springs 45. Each of the positioning posts 44 is disposed on the support base 1 and parallel to the water inlet pipe 5, the limiting block 42 is mounted on a front end of each of the positioning posts 44, the limiting block 42 is disposed with a round mounting hole 421, and the adjustment sleeve 3 is sleeved in the round mounting hole 421. The first adjustment block 411 and the second adjustment block 412 are located between the support base 1 and the limiting block 42, the first adjustment block 411 is provided with a first keyway 4111 matching with each of the positioning posts 44, and the second adjustment block 412 is provided with a second keyway 4121 matching with each of the positioning posts 44. Each of the compression springs 45 is disposed between the support base 1 and the second adjustment block 412, a rear end of each of the compression springs 45 is connected with the support base 1, and a front end of each of the compression springs 45 is connected with or in close contact with the second adjustment block 412. The rotary housing 43 is rotatably mounted on the support base 1, the adjustment sleeve 3 is fixedly mounted on a front end portion of the rotary housing 43, and the water inlet pipe 5, the nozzle 2, the limiting block 42, the adjustment member 41, each of the positioning posts 44, and each of the compression springs 45 are all located in the rotary housing 43.

The following briefly describes the working principle of one embodiment of the integrated device for water streaming and spraying:

When in use, one embodiment of the support base 1 of the above-mentioned integrated device for water streaming and spraying can be installed on a toy water gun, a rear end of the water inlet pipe 5 communicates with a water outlet of the toy water gun, and the toy water gun is capable of transporting water through the water outlet to the water inlet pipe 5 of the integrated device for water streaming and spraying.

When the toy water gun is set to spraying water, one embodiment of the adjustment sleeve 3 is driven to rotate about its rotation axis by rotating the rotary housing 43, each of the guide sliders 32 is caused to move along the corresponding guide groove 4102 on the adjustment member 41, moving from the guide transition section 41022 to the positioning section 41021 of the guide groove 4102. (At this time, the second adjustment block 412 has a tendency to move toward the first adjustment block 411 under action of each of the compression springs 45, and the rear guiding surface 4141 presses the guide slider 32 on the adjustment sleeve 3 against the front guiding surface 4131 tightly to realize positioning of the adjustment sleeve 3.) The adjustment sleeve 3 is caused to reach a rear position, at this time, an edge of a groove opening of the opened diversion groove 222 contacts and fits with a rear side of the sealing plate 31. When the toy water gun is transporting water to the integrated device for water streaming and spraying, the water transported from the toy water gun flows into each of the diversion cavities through the water inlet pipe 5 and a rear end opening of the outer tube 21, and then enters the opened diversion groove 222 from the corresponding notches 2221 and flows out from the groove opening of the opened diversion groove 222 to form a plurality of water currents with different flow directions which are directly ejected through the water jet hole 311 on the sealing plate 31. Since a distance between the nozzle 2 and the water jet hole 311 is close, and the flow directions of the water currents are different, a chance of collision between the water currents and an inner wall of the water jet hole 311 is effectively increased, causing the water currents ejected from the water jet hole 311 to be uniformly sprayed around to present the spray pattern, and leaving the toy water gun in a usage mode of spraying water.

When the toy water gun needs to be in streaming mode, one embodiment of the adjustment sleeve 3 is driven to rotate about its rotation axis in an opposite direction by rotating the rotary housing 43 to cause each of the guide sliders 32 to move along the corresponding guide groove 4102 on the adjustment member 41, moving from the positioning section 41021 to a front end of the guide transition section 41022 of the guide groove 4102. (At this time, the second adjustment block 412 moves toward the first adjustment block 411 under action of each of the compression springs 45, so that a spacing between the rear guiding surface 4141 and the front guiding surface 4131 is reduced to realize the guide slider 32 on the adjustment sleeve 3 being incapable of moving along the guide transition section 41022 to achieve positioning of the adjustment sleeve 3.) The adjustment sleeve 3 is caused to reach a front position, at this time, the edge of the groove opening of the opened diversion groove 222 is separated with the rear side of the sealing plate 31. When the toy water gun is transporting water to the integrated device for water streaming and spraying, the water transported from the toy water gun flows into each of the diversion cavities of the nozzle 2 through the water inlet pipe 5, and then flows out from a front end of the outer tube 21 or the groove opening of the opened diversion groove 222 to form a plurality of water currents with different flow directions. The water currents are merged and diverted into a cavity of the adjustment sleeve 3 and finally ejected from the water jet hole 311 on the sealing plate 31, so that the ejected water current is columnar, and the toy water gun is in a usage mode of streaming water.

In addition, it should be explained that each of the part names of the specific embodiments described in the specification can be named differently, equivalent or simple changes made according to the structures, features and principles described in the concept of the present invention still fall within the scope covered by the technical solutions of the present invention. Technical personnel skilled in the art to which the present invention pertains can make various modifications or additions to the specific embodiments described or replace them in a similar manner, which still fall within the protection scope of the present invention as long as they do not depart from the structures of the present invention or are not beyond the scope defined by the appended claims.

LIST OF REFERENCED PARTS support base 1
nozzle 2
outer tube 21
inner tube 22
partition plate 221
opened diversion groove 222
notch 2221
guide vane 223
adjustment sleeve 3
sealing plate 31
water jet hole 311
guide slider 32
position adjustment mechanism 4
adjustment member 41
cylindrical retaining wall 4101
guide groove 4102
positioning section 41021
guide transition section 41022
first adjustment block 411
first keyway 4111
second adjustment block 412
second keyway 4121
first arcuate wall 413
front guiding surface 4131
second arcuate wall 414
rear guiding surface 4141
limiting block 42
round mounting hole 421
rotary housing 43
positioning post 44
compression spring 45
water inlet pipe 5
sealing ring 6

What is claimed is:

1. An integrated device for water streaming and spraying comprising:

a support base;

a water inlet pipe, the water inlet pipe being mounted on the support base and disposed along front and rear directions;

a nozzle, the nozzle comprising an outer tube and an inner tube, the outer tube being mounted on a front end of the water inlet pipe;

an adjustment sleeve, the adjustment sleeve being sleeved on an outer side of the outer tube;

a position adjustment mechanism capable of adjusting a position of the adjustment sleeve along the front and rear directions;

a rear end of the outer tube communicating with the front end of the water inlet pipe, the inner tube being disposed in a cavity of the outer tube;

a front end of the inner tube protruding from a front end opening of the outer tube;

a cavity of the inner tube being provided with a partition plate, the partition plate and an inner wall of the front end of the inner tube together encircling to form an opened diversion groove;

a groove wall of the opened diversion groove being provided with at least one notch;

an outer side surface of the inner tube being provided with a plurality of guide vanes arranged in a circumferential direction of the inner tube;

an outer edge of each of the guide vanes contacting and fitting with an inner side surface of the outer tube;

an inner side surface of the adjustment sleeve making sealing contact with an outer side surface of the outer tube;

a front end of the adjustment sleeve being disposed with a sealing plate; and a water jet hole being disposed on the sealing plate, the water jet hole being located directly in front of the opened diversion groove.

2. The integrated device for water streaming and spraying as claimed in claim 1, wherein a sealing ring is fixedly mounted on the outer side surface of the outer tube, and the outer side surface of the outer tube makes sealing contact with the inner side surface of the adjustment sleeve through the sealing ring.

3. The integrated device for water streaming and spraying as claimed in claim 1, wherein the position adjustment mechanism comprises an adjustment member, the adjustment member is mounted on the water inlet pipe, the adjustment member is provided with a cylindrical retaining wall, the adjustment sleeve is sleeved on an inner side of the cylindrical retaining wall, the cylindrical retaining wall is provided with at least one guide groove, the at least one guide groove has a positioning section and a guide transition section, the positioning section extends along a circumferential direction of the cylindrical retaining wall, the guide transition section gradually extends from front to rear toward the circumferential direction of the cylindrical retaining wall, and a rear end of the guide transition section is connected with one end of the positioning section, the adjustment sleeve is provided with at least one guide slider, a quantity of the at least one guide slider is the same as that of the at least one guide groove, each of the at least one guide sliders corresponds to one of the at least one guide grooves, and each of the at least one guide sliders is located in the corresponding at least one guide groove.

4. The integrated device for water streaming and spraying as claimed in claim 3, wherein the adjustment member comprises a first adjustment block and a second adjustment block, the first adjustment block and the second adjustment block are respectively sleeved on the water inlet pipe, at least one first arcuate wall is disposed on the first adjustment block, at least one second arcuate wall is disposed on the second adjustment block, each of the at least one first arcuate walls and each of the at least one second arcuate walls together encircle to form the cylindrical retaining wall of the adjustment member, the at least one first arcuate wall is provided with at least one front guiding surface, the at least one second arcuate wall is provided with at least one rear guiding surface, a quantity of the at least one rear guiding surface is the same as that of the at least one front guiding surface, each of the at least one rear guiding surfaces corresponds to one of the at least one front guiding surfaces, the at least one rear guiding surface is located behind the at least one front guiding surface and both are directly opposite each other, and the at least one rear guiding surface and the at least one front guiding surface together encircle to form the at least one guide groove on the cylindrical retaining wall, the position adjustment mechanism further comprises a limiting block, at least two positioning posts, and at least two compression springs, each of the positioning posts is disposed on the support base and parallel to the water inlet pipe, the limiting block is mounted on a front end of each of the positioning posts, the limiting block is disposed with a round mounting hole, and the adjustment sleeve is sleeved in the round mounting hole, the first adjustment block and the second adjustment block are located between the support base and the limiting block, the first adjustment block is provided with a first keyway matching with each of the positioning posts, and the second adjustment block is provided with a second keyway matching with each of the positioning posts, each of the compression springs is disposed between the support base and the second adjustment block, a rear end of each of the compression springs is connected with the support base, and a front end of each of the compression springs is connected with or in close contact with the second adjustment block.

5. The integrated device for water streaming and spraying as claimed in claim 4, wherein the position adjustment mechanism further comprises a rotary housing, the rotary housing is rotatably mounted on the support base, the adjustment sleeve is fixedly mounted on a front end portion of the rotary housing, and the water inlet pipe, the nozzle, the limiting block, the adjustment member, each of the positioning posts, and each of the compression springs are all located in the rotary housing.

6. The integrated device for water streaming and spraying as claimed in claim 2, wherein the position adjustment mechanism comprises an adjustment member, the adjustment member is mounted on the water inlet pipe, the adjustment member is provided with a cylindrical retaining wall, the adjustment sleeve is sleeved on an inner side of the cylindrical retaining wall, the cylindrical retaining wall is provided with at least one guide groove, the at least one guide groove has a positioning section and a guide transition section, the positioning section extends along a circumferential direction of the cylindrical retaining wall, the guide transition section gradually extends from front to rear toward the circumferential direction of the cylindrical retaining wall, and a rear end of the guide transition section is connected with one end of the positioning section, the adjustment sleeve is provided with at least one guide slider, a quantity of the at least one guide slider is the same as that of the at least one guide groove, each of the at least one guide sliders corresponds to one of the at least one guide grooves, and each of the at least one guide sliders is located in the corresponding at least one guide groove.

7. The integrated device for water streaming and spraying as claimed in claim 6, wherein the adjustment member comprises a first adjustment block and a second adjustment block, the first adjustment block and the second adjustment block are respectively sleeved on the water inlet pipe, at least one first arcuate wall is disposed on the first adjustment block, at least one second arcuate wall is disposed on the second adjustment block, each of the at least one first arcuate walls and each of the at least one second arcuate walls together encircle to form the cylindrical retaining wall of the adjustment member, the at least one first arcuate wall is provided with at least one front guiding surface, the at least one second arcuate wall is provided with at least one rear guiding surface, a quantity of the at least one rear guiding surface is the same as that of the at least one front guiding surface, each of the at least one rear guiding surfaces corresponds to one of the at least one front guiding surfaces, the at least one rear guiding surface is located behind the at least one front guiding surface and both are directly opposite each other, and the at least one rear guiding surface and the at least one front guiding surface together encircle to form the at least one guide groove on the cylindrical retaining wall, the position adjustment mechanism further comprises a limiting block, at least two positioning posts, and at least two compression springs, each of the positioning posts is disposed on the support base and parallel to the water inlet pipe, the limiting block is mounted on a front end of each of the positioning posts, the limiting block is disposed with a round mounting hole, and the adjustment sleeve is sleeved in the round mounting hole, the first adjustment block and the second adjustment block are located between the support base and the limiting block, the first adjustment block is provided with a first keyway matching with each of the positioning posts, and the second adjustment block is provided with a second keyway matching with each of the positioning posts, each of the compression springs is disposed between the support base and the second adjustment block, a rear end of each of the compression springs is connected with the support base, and a front end of each of the compression springs is connected with or in close contact with the second adjustment block.

8. The integrated device for water streaming and spraying as claimed in claim 7, wherein the position adjustment mechanism further comprises a rotary housing, the rotary housing is rotatably mounted on the support base, the adjustment sleeve is fixedly mounted on a front end portion of the rotary housing, and the water inlet pipe, the nozzle, the limiting block, the adjustment member, each of the positioning posts, and each of the compression springs are all located in the rotary housing.

* * * * *